United States Patent [19]

Burchett

[11] Patent Number: 5,032,019

[45] Date of Patent: Jul. 16, 1991

[54] EYEGLASS WRAP

[76] Inventor: Roy W. Burchett, 1330 Winston Ct., Upland, Calif. 91786

[21] Appl. No.: 118,283

[22] Filed: Nov. 6, 1987

[51] Int. Cl.[5] ..... G02C 1/00

[52] U.S. Cl. ..... 351/158; 206/5; 248/902

[58] Field of Search ..... 351/158; 206/5 R; 248/DIG. 2

[56] References Cited

U.S. PATENT DOCUMENTS

| | | | |
|---|---|---|---|
| 2,913,100 | 11/1959 | Carmichael | 206/5 R |
| 3,381,806 | 5/1968 | McOrnagh | 206/5 R |
| 4,290,522 | 9/1981 | Takaski | 206/5 |

*Primary Examiner*—Paul M. Dzierzynski

*Attorney, Agent, or Firm*—Alan H. Thompson

[57] ABSTRACT

An eyeglass wrap has a flat sheet of flexible material that folds about a pair of eyeglasses with releasable fastening strips. The flexible material may be fabric-covered closed cell sponge rubber and the sheet may contain orifices that allow temples of eyeglasses to pass through to a distance that provides coverage of the lenses and frame of the eyeglasses by the sheet. The sheet may include an extended portion that further wraps around the folded temples of enclosed eyeglasses to secure the temples to the exterior surface of the wrap. The sheet is unfoldable from a folded condition to a flat condition.

29 Claims, 2 Drawing Sheets

EYEGLASS WRAP

BACKGROUND OF THE INVENTION

The invention relates to a storage enclosure for eyeglasses.

A variety of eyeglass or sunglass cases or enclosures are known. Eyeglasses have been stored in box-like containers, as for example, those often called "coffin" cases having side hinges that open and close a lid. Another case is an envelope-type having an open top end into which one of the hinged ends of the eyeglasses may be slipped. Another case is a "pouch"-type wherein both hinged ends of the eyeglasses may be simultaneously placed into the pouch.

In recent years eyeglass and sunglass manufacturers and designers have developed eyeglasses having a variety of shapes and sizes (and of varying economic quality) for the lenses, frames, temples (or bow pieces), hinges, nosepieces, points of attachment on the frame for the temples, and the like. For instance, frame widths may be wider than the wearer's head width, or temples may be attached to the frame near the wearer's cheekbones. Some eyeglasses, and particularly sunglasses, contain lenses that wrap around toward the side of the wearer's head, while others contain temples that taper from the side of the frame near the hinge to more narrow dimensions near the ear. Heights of frames and lenses vary from relatively small dimensions, such as "granny" glasses, to relatively large ones that fit from well above the wearer's eyebrow to well below the wearer's cheekbone.

Problems have arisen for storing such eyeglasses when the eyeglasses are not in use. Such problems include breakage or scratching of the lenses and bending or breaking of the frames or temples. Many relatively rigid materials have been employed to deter breakage, particularly of glass lenses, and a variety of soft, nonabrasive materials have been employed to prevent scratching, particularly of plastic lenses. Often times the eyeglass case is constructed to allow the temples to be folded against the inside surfaces of the lenses or frames causing scratching of the inside surfaces of the lenses.

Problems have also arisen when the eyeglasses, and particularly sunglasses, are being worn by a wearer and the wearer must store the eyeglass case. Often the eyeglass case is bulky and difficult to store in a wearer's pocket, or other conventional storing places. Also, present eyeglass cases trap particles of sand, dirt and other debris in the permanent seams, corners, pouches, etc., and such particles can cause scratching and deterioration of the frames, lenses, temples, etc.

SUMMARY OF THE INVENTION

The present invention relates to a wrap for eyeglasses. The wrap contains a flat sheet of flexible material sized and shaped to simultaneously cover at least a major portion of both the inside and outside surfaces of the lenses and frame of a pair of eyeglasses. The sheet is folded (or wrapped) about an axis traversing opposite sides of the sheet so that a top portion of the sheet covers the outside surfaces of the lenses and frame of the eyeglasses and a bottom portion of the sheet covers the inside surfaces of the lenses and frame of the eyeglasses. The top and bottom portions of the sheet are fastened by releasable fastening means attached to the sheet to enclose the eyeglasses. The sheet is unfoldable from the folded condition to a flat condition. It is, of course, preferred to provide means for securing the temples against the exterior surface of the bottom portion of the sheet. Although the wrap may comprise a number of flexible materials, a closed-cell sponge neoprene, preferably a fabric-covered closed cell sponge neoprene, is highly desirable. Also, the releasable fastening means are preferably flat hook or loop strips, such as Velcro strips, which retain the flat character of the unwrapped sheet. When not in use for wrapping eyeglasses, the unfastened flat wrap can conveniently be stored and does not accumulate particles of dirt, sand, debris, etc.

In a preferred embodiment, the flat sheet also contains at least one, and preferably at least two, orifices. Each orifice is sized to allow receipt of a temple of the eyeglasses. Each orifice of a pair of orifices is positioned at sufficient distances from the other to allow the interior surface of the sheet located between the pair to generally contour to the inside surfaces of the lenses and frame of the eyeglasses. When the temples are passed through the orifices, the pair of eyeglasses is not easily separated from the wrap, particularly when the temples are folded. Either temple may be inserted into either orifice so that the eyeglasses may be wrapped with its nose space either upward or downward relative to the sheet. In an alternative embodiment, temples of the eyeglasses may be fitted in juxtaposition to indentations, preferably notched indentations, of the side edges of the sheet. Such an embodiment provides a wearer the advantage of enclosing the lenses and frame of the eyeglass while both temples remain attached to a continuous eyeglass retainer.

In a more preferred embodiment, the top edge of the top portion of the sheet is extended to provide an extension top edge portion of the sheet that may be wrapped over folded temples of the eyeglasses to secure the temples against the exterior surface of usually the bottom portion of the sheet. In this embodiment, the extension top edge portion contains fastening means, usually close to the top edge of the sheet, thus eliminating the necessity that the top portion of the sheet contain fastening means.

A significant advantage of the invention is the relative ease of preparing the wrap, by simply cutting the shape of the flexible material, including the orifices, and attaching the releasable fastening means to the cut out sheet at as few as two locations on the sheet. Another advantage of the invention is that the inside surfaces of the lenses of the wrapped eyeglasses are not contacted by the temples, and thus, scratching of such lenses resulting therefrom is avoided. Also, any loose water, snow, sand particles, and the like, can readily be shaken out or removed from the wrapped eyeglasses without the wrap having to be unfastened. Furthermore, in some instances the wrapped eyeglasses may float when a preferred closed cell sponge material is employed.

DESCRIPTION OF THE INVENTION

The eyeglass wrap of the invention may be employed to cover a variety of shapes and sizes of eyeglasses including lenses, frames and temples. The temples, as herein referred, include entire parts of the eyeglass piece attached to the frame that extend along the side of the wearer's head and behind the ear. A pair of eyeglasses as referred to herein, includes sunglasses, ophthalmic prescription eyeglasses, goggles, safety eyeglasses, spectacles, and the like, having lenses through which the wearer's eye can see.

The sheet of flexible material is preferably of essentially uniform thickness, usually of less than one half, and preferably less than one fourth inch cross-sectional thickness. The flexible material may be pliable, supple, elastic and/or soft. Examples of suitable materials are rubber, including sponge rubber, foam rubber, neoprene, and fabric-covered rubber, or fabric-covered neoprene, and the like; animal hide, including leather, shammy, particularly sheep shammy, and the like; and natural and synthetic fabrics, including wool, cotton, linen, synthetic rubber, synthetic leather, nylon, rayon, and the like. Although not required, it is preferred that the flexible material have a specific gravity less than 1. Preferred flexible materials include a closed cell sponge rubber or neoprene, particularly those that are fabric-covered, i.e. fabrics that are laminated to the flexible material. Examples of fabrics covering (laminated to) the closed cell material include nylon, lycra, terry, plush, and the like.

The sheet is sized and shaped to cover at least a major portion of the inside surface and at least a major portion of the outside surface of the lenses and frame of a pair of eyeglasses. A major portion of the inside or outside surfaces of a lens and frame generally includes at least about 90 percent of the surface areas thereof, and further includes the part of the inside surface area contacted by folded temples of the eyeglasses. However, the sheet is preferably constructed to essentially completely cover both the inside and outside surfaces of the lenses and frame of the eyeglasses by performing a simple bend or fold about an axis traversing opposite sides of the sheet. The folded sheet enclosing the eyeglasses is fastened by releasable fastening means to retain the sheet in its folded condition. When the top and bottom portions of the sheet are unfastened and enclosed eyeglasses removed therefrom, the sheet is capable of being readily and easily flattened to return to essentially its pre-wrapped flat condition. Further, the sheet preferably is constructed with additional material extending from the edge of the bent or folded sheet covering the outside surfaces of the lenses and frame so that the extended sheet can be bent or folded about a second axis to cover folded temples of a pair of wrapped eyeglasses to secure the folded temples to the sheet with releasable fastening means.

Releasable fastening means as used herein refer to those fastening means which fix the fastened portions of the sheet so that unfastening of such portions requires no material alteration of the wrap. For instance, no permanent seams or permanent stitches need be altered when returning the flat sheet to its unfolded, unfastened and flat conditions. Releasable fastening means including coacting hook and loop, snaps, hooks, loops, and the like. Preferred releasable fastening means are flat hook or loop strips, such as Velcro strips, fixedly (and permanently) mounted on the interior or exterior surface of the sheet to coact with an appropriate hook or loop strip fixedly mounted in another area or portion of the sheet.

The wrap is a normally flat sheet when portions thereof are not fastened or no eyeglasses or other objects are wrapped therein. As used herein, a flat sheet of flexible material refers to the sheet being capable of being unfolded and spread out upon a continuous horizontal surface when unfastened. Although the flexible material may return from a fastened status to unfastened status and temporarily retain a slightly non-flat contour with the continuous horizontal surfaces, the wrap is herein is considered essentially normally flat in its unfastened status due to its capability of readily and easily being flattened.

The flat and flexible nature of the unfastened wrap containing no eyeglasses is advantageous for conveniently storing the wrap when not in use. For example, the may be stored in a flat area, such as between pages in a book, or slightly non-flat areas, such as in a waistline belt area, or more rounded areas, such as inside a wearer's sock near the ankle or calf. Orifices strategically placed on the wrap, and of sufficient size and shape, provide for storage by attachment to the wearer's waist belt, or to other straps, cords, ropes, and the like, that can be threaded through the orifice and secured to the wearer.

It is highly preferred that the wrap contain at least one strategically located orifice (aperture or opening) on the sheet of flexible material to allow at least a portion of a temple from eyeglasses to be received therefrom. The shape of the orifice contains at least one straight or curved line, as for example, a slit, circle, ellipse, square or rectangle. Usually the sheet contains at least a pair of orifices of sufficient size and distance from each other to allow passage therethrough of eyeglass temples to a distance that the portion of the sheet located between the pair of orifices is generally contoured to the lenses and frame of the eyeglasses. A multiplicity of orifices of different size, shape and distance from other orifices may be contained on the same wrap, to provide adjustability of the wrap to different sized and shaped eyeglasses and different wrapping modes.

DESCRIPTION OF THE ILLUSTRATED EMBODIMENTS

Figure 1:
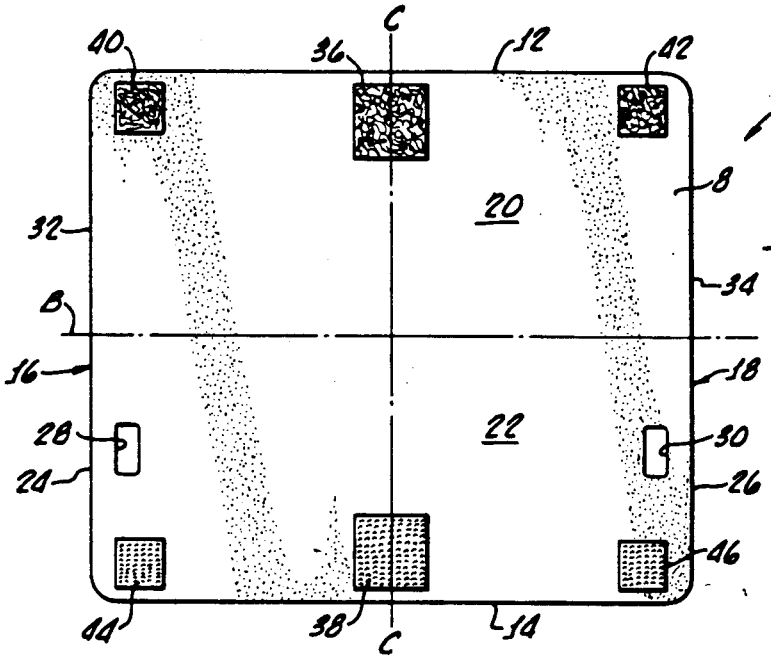
FIG. 1 is a plan view of the interior surface of an eyeglass wrap of the instant invention.

Referring to the drawings, the wrap for a pair of eyeglasses or sunglasses of one embodiment (FIGS. 1, 2 and 3) of the instant invention has a flattenable continuous sheet 10 of rectangularly or square shaped flexible material having a top edge 12, bottom edge 14 and two general side edges 16 and 18. Bottom edge 14 normally extends perpendicularly to general side edges 16 and 18 that extend parallel to each other approximately one half their length along bottom side edges 24 and 26 and top-side edges 32 and 34, respectively, and intersect top edge 12.

FIG. 1 shows the interior surface 8 of sheet 10. Sheet 10 is partitioned along bending axis B into a top portion 20 and a bottom portion 22. Bending axis B is typically parallel to top edge 12 and bottom edge 14 and generally bisects sheet 10 (except when top portion 20 contains additional material extending top edge 12, as will be discussed hereinafter).

Optionally, and preferably, bottom portion 22, bordered by bottom edge 14 perpendicularly extending at each end to bottom-side edges 24 and 26 that intersect with bending axis B, contains orifices 28 and 30, preferably located close to bottom-side edges 24 and 26 and normally equidistant from a top edge-to-bottom edge centerline C that usually bisects sheet 10. Orifices 28 and 30 are of sufficient size and distance from each other to allow two separate temples of a pair of eyeglasses (FIG. 2) to pass through for a sufficient distance to allow the interior surface of bottom portion 22 to generally contour to the inside surfaces of the eyeglass lenses and frames. Top portion 20, bordered by top edge 12 perpendicularly extending at each end to top-side edges 32 and 34 that intersect with bending axis B, contains an attached flat hook or loop releasable fastening strip 36, located on or about top edge-to-bottom edge centerline C close to top edge 12. Bottom portion 22 contains an attached flat hook or loop releasable fastening strip 38 (hook, if fastening strip 36 is loop or vice versa), located on or about top edge-to-bottom edge centerline C close to bottom edge 14.

Optionally, and preferably, top portion 20 contains attached flat hook or loop releasable fastening strips 40 and 42 located close to the intersection of top edge 12 with top-side edge 32 and top edge 12 with top-side edge 34, respectively, i.e. near the top-most corners of sheet 10. Correspondingly, bottom portion 22 optionally and preferably contains attached flat hook or loop releasable fastening strips 44 and 46 located close to the intersection of with bottom-side edge 26, respectively, i.e. near the bottom-most corners of sheet 10.

Figure 2:
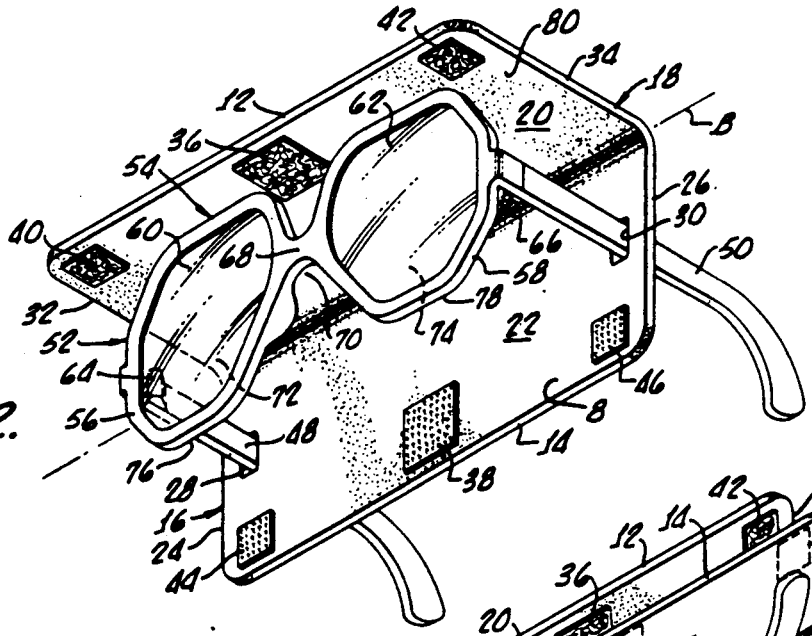
FIG. 2 is an isometric view of predominantly the interior surface of the eyeglass wrap of FIG. 1 and a pair of eyeglasses wherein the eyeglass temples are shown partially passing through orifices in the wrap that are positioned in the bottom portion of the wrap and the space below the nosepiece of the eyeglass frame is positioned distally to the interior surface of the wrap.

In FIG. 2, predominantly interior surface 8 of bottom edge 14, and side edge 18 of the eyeglass wrap of the invention comprising sheet 10 is shown having temples 48 and 50 of the pair of eyeglasses 52 partially passed through orifices 28 and 30, respectively. The pair of eyeglasses 52 contain a frame 54 (shown generally) having a frame portion 56, including an exterior surface, and a second frame portion 58, including an exterior surface, in contact with a first lens 60 including an exterior surface, and a second lens 62, including an exterior surface, respectively, and hingedly attached at areas 64 and 66 to respective temples 48 and 50. Nosepiece 68 bridges lenses 60 and 62 and the shape of nosepiece 68 provides a nose-space 70 in which fits the eyeglass wearer's nose. During use of the wrap of the invention for enclosing a pair of glasses, temples 48 and 50 are received through orifices 28 and 30, respectively, to a distance allowing interior surface 8 of bottom portion 22 of sheet 10 to generally contour to interior surfaces 72 and 74 of lenses 60 and 62, respectively, and interior surfaces 76 and 78 of respective frame portions 56 and 58. Such a distance allows temples 48 and 50 to fold at folding areas 64 and 66, respectively, and to contact exterior surface 80 of bottom portion 22 or the other temple (see FIG. 3).

Figure 3:
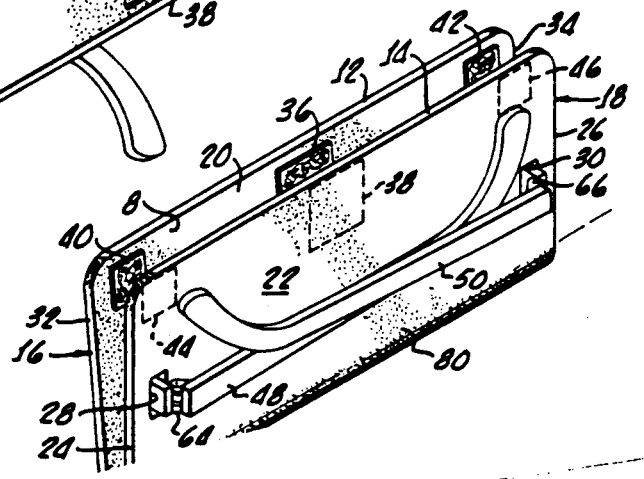
FIG. 3 is an isometric view including both the interior and exterior surfaces of the eyeglass wrap of FIGS. 1 and 2 and a pair of folded eyeglass temples having been received by the orifices of the wrap and wherein the interior surface of the wrap contacts and contours with the inside surfaces of the eyeglass lenses (now shown) and the frame (not shown).

In FIG. 3, sheet 10 is bent and folded about bending axis B to simultaneously cover a major portion of the outside surfaces and inside surfaces of lenses 60 and 62, frame 54, including frame portions 56 and 58, and nosepiece 68. Flat releasable fastening strips 36 and 38 coact to fasten bottom portion 22 to top portion 20. Fastening strips 36 and 38 are conveniently located to coact in the vicinity of nosepiece 70 of the wrapped eyeglasses. Optionally, and preferably, flat releasable fastening strips 46 and 42 coact to fasten bottom portion 22 to top portion 20 and flat releasable fastening strips 44 and 40 may coact to fasten bottom portion 22 to top portion 20 (shown unfastened in FIG. 3).

Figure 9:
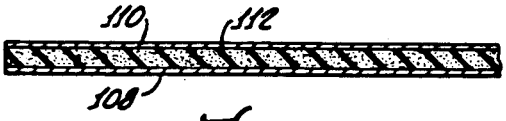
FIG. 9 is a cross-sectional view of a fabric-covered flexible material having a closed-cell structure as shown generally in FIG. 4.

A preferred embodiment of the eyeglass wrap of the invention (FIGS. 4, 5, 6 and 7) has a normally flat continuous sheet 100 (FIG. 4) of generally hexagonal (or pentagonal) shaped flexible material, such as fabric-covered closed cell sponge neoprene cross-sectionally shown in FIG. 9 with interior fabric cover 108 and exterior fabric cover 110 and closed cell sponge neoprene 112, and having a top edge 12A, bottom edge 14A and two side edges generally shown as 90 and 92. Bottom side-edge 14A is extended perpendicularly at each end to general side edges 90 and 92 that extend parallel to each other approximately one half to three fourths of each of their lengths along bottom-side edges 24A and 26A and top-side edges 32A and 34A, respectively, and taper inwardly toward and intersect with top edge 12A along extension top-side edges 96 and 94.

Figure 4:
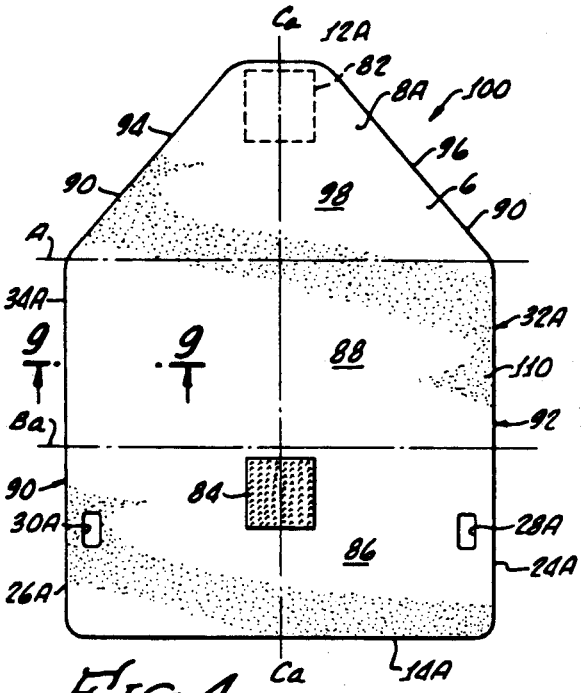
FIG. 4 is a plan view of the exterior surface of an eyeglass wrap of a preferred embodiment of the instant invention.

FIG. 4 shows the exterior surface 6 of sheet 100. Sheet 100 is partitioned along bending axis Ba into a top portion 88, including an extension top edge portion 98, and a bottom portion 86. Top edge 12A and bottom edge 14A are typically parallel to bending axis Ba which traverses side edges 90 and 92 at a point where bottom-side edges 26A and 24A meet top-side edges 34A and 32A, respectively. A second bending axis A, which is parallel to bending axis Ba, traverses general side edges 90 and 92 at a point where top-side edges 34A and 32A meet the extension top-side edges 94 and 96, respectively. In general, bending axes A and Ba serve to divide sheet 100 into the three portions (1) bottom portion 86, bordered by bottom edge 14A extending at each end perpendicularly to bottom-side edges 24A and 26A that intersect with bending axis Ba, (2) top portion 88, bordered by bending axes A and Ba and top-side edges 32A and 34A, and (3) extension top edge portion 98, bordered by top edge 12A, bending axis A and extension top-side edges 94 and 96. Each of top portion 88 and portion 86 provides a sufficient surface area by sheet 100 to essentially cover at least the vertical and horizonal dimensions of the eyeglass frame and lenses (shown generally in FIG. 5) and additional surface areas for at least two bending (folding) areas of sheet 100.

Optionally, and preferably, bottom portion 86 contains orifices 28A and 30A, preferably located close to bottom-side edges 24A and 26A and usually equidistant from a top edge-to-bottom edge centerline Ca that bisects sheet 100 Bottom portion 86 contains a sufficient surface area of sheet 100 for its interior surface 22A (FIG. 5) to cover the inside surfaces of the lenses and frame of a pair of eyeglasses, and also contains flat hook or loop releasable fastening strip 84 attached on or about the top edge-to-bottom edge centerline Ca close to bending axis Ba on the exterior of surface 6 (i.e. on bottom portion 86). Top portion 88 contains a sufficient surface area of sheet 100 for its interior surface 20A (FIG. 5) to cover the outside surfaces of the lenses and frame of a pair of eyeglasses. Extension top edge portion 98 contains flat hook or loop releasable fastening strip 82 attached to the interior of surface 8A, (i.e. interior surface of extension top edge portion 98) and close to top edge 12A (FIG. 5).

Figure 5:
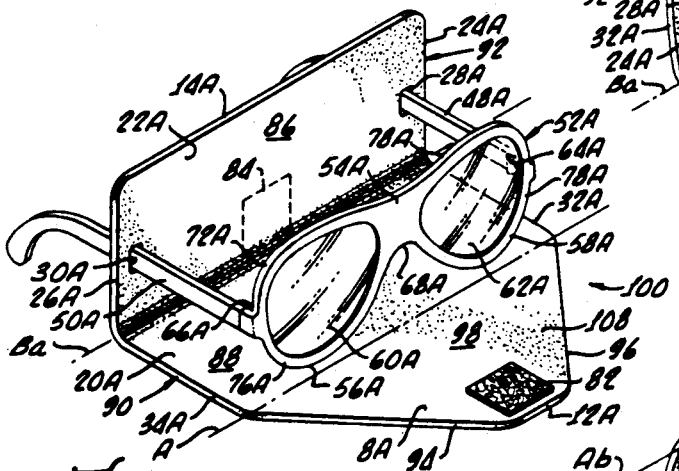
FIG. 5 is an isometric view of predominantly the interior surface of the eyeglass wrap of FIG. 4 and a pair of eyeglasses wherein the eyeglass temples are shown partially passing through orifices in the wrap that are positioned in the bottom portion of the wrap and the space below the nosepiece of the eyeglass frame is positioned proximally to the interior surface of the wrap.

In FIG. 5, orifices 28A and 30A of the bottom portion 22A are of sufficient size and distance from each other to allow two separate temples 48A and 50A of a pair of eyeglasses 52A to pass through for a sufficient distance to allow the interior surface 8A of bottom portion 22A to generally contour to the inside surfaces 72A and 74A of the eyeglass lenses 60A and 62A, nosepiece 68A bridging the lenses, and frame 76A and 78A. The pair of eyeglasses 52A usually contain a frame 54A (shown generally) having a frame portion 56A, including an exterior surface, and a frame portion 58A including an exterior surface, in contact with the first lens 60A and second lens 62A, respectively and hingedly attached at respective folding areas 64A and 66A to respective temples 48A and 50A. The pair of eyeglasses 52A (FIG. 5) or 52 (FIG. 2) may also be fitted to the respective sheets 100 and 10 in an inverted manner to that shown. For example, in FIG. 5, temple 50A may be inserted into orifice 28A while temple 48A is inserted into orifice 30A. Also, in FIG. 2, temple 50 may be inserted into orifice 28 while temple 48 is inserted into orifice 30.

Figure 6:
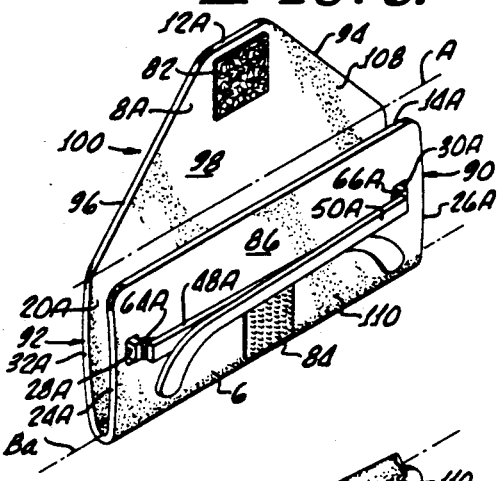
FIG. 6 is an isometric view including both the interior and exterior surfaces of the eyeglass wrap of FIGS. 4 and 5 and a pair of folded eyeglass temples having been received by the orifices of the wrap and wherein the interior or surface of the wrap contacts and generally contours with the inside surfaces of the eyeglass lenses (not shown) and frame (not shown).

In FIG. 6, temples 48A and 50A are passed through orifices 28A and 30A, respectively, to a distance that allows the temples to fold at folding areas 64A and 66A and to contact exterior surface 6 on bottom portion 86. In FIG. 6, sheet 100 is bent and folded about bending axis Ba to simultaneously cover a major portion of the outside surfaces and inside surfaces of lenses 60A and 62A, frame 54A, including frame portions 56A and 58A and nosepiece 68A (see also FIG. 5).

Figure 7:
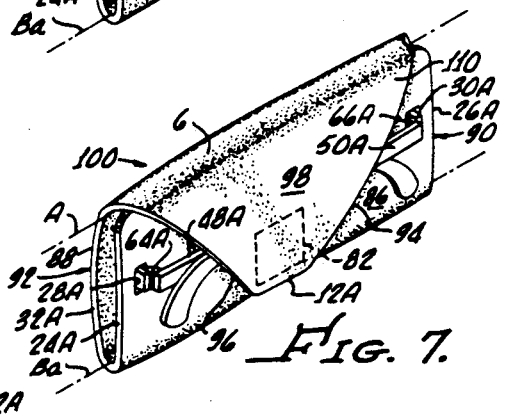
FIG. 7 is an isometric view of predominantly the exterior surface of the eyeglass wrap of FIGS. 4 and 6 and a pair of folded eyeglass temples having been received through the orifices of the wrap as in FIG. 6 and wherein an extension of the top portion of the wrap is fastened to the exterior surface of the wrap to secure the folded temples against the wrap.

In FIG. 7, the exterior surface of extension top edge portion 98 is shown bending about bending axis A to both cover and secure temples 48A and 50A against the exterior surface of bottom portion 86. Flat hook or loop releasable fastening strip 82 coacts with flat hook or loop releasable fastening strip 84 (not shown, see FIG. 6) to fasten extension top edge portion 98 to bottom portion 86. Such fastening, in effect, serves to place bottom edge 14A of bottom portion 86 (22A in FIG. 5) in juxtaposition with bending axis A bordering top portion 88 (top portion 20A in FIG. 5).

Figure 8:
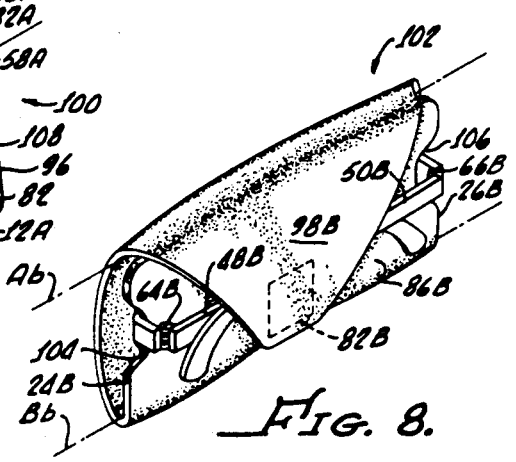
FIG. 8 is an isometric view of predominantly the exterior surface of an eyeglass wrap like in FIG. 7 except indentations of the side portions of the wrap replace the orifices of FIG. 7.

FIG. 8 shows an alternative sheet 102 for orifices 28A and 30A of FIGS. 4–7. Sheet 102 is folded about bending axes Ab and Bb and fastened with eyeglasses contained therein, in the same manner as FIG. 7. Bottom portion 86B of sheet 102 contains notched indentation 104 on bottom side edge 24B and notched indentation on 106 on bottom side edge 26B. Notched indentations 104 and 106 are shown to be of sufficient size, shape and distance from the other so as to be in juxtaposition with respective folding areas 64B and 66B of respective temples 48B and 50B. Furthermore, bottom portion 86B is generally contoured to the inside surfaces of the lenses and frame of the enclosed pair of eyeglasses (not shown). Notched indentations 106 and 104 are of sufficient size and shape to restrict significant sliding movement of bottom portion 86B over the frame and inside surfaces of the lenses of the eyeglasses particularly when extension top edge portion 98B is fastened to bottom portion 86B by hook and loop releasable coacting fastening strips 82B and 84B (not shown, but attached in the same location as releasable fastening means 84 of FIG. 4). The sliding movement restricted is normally lateral movement as well as movement multidirectionally about the top edge-to-bottom edge centerline Ca bisecting sheet 102.

While particular embodiments of the invention have been described, it will be understood, of course, that the invention is not limited thereto since many obvious modifications can be made, and it is intended to include within this invention any such modifications as will fall within the scope of the invention as defined by the appended claims.

I claim:

1. A wrap for eyeglasses, said wrap comprising a flat sheet of flexible material, said sheet being foldable from a flat condition about an axis traversing opposite sides of said sheet into a folded condition in which at least a major portion of inside and outside surfaces of lenses and frame of said eyelasses are covered and said sheet comprising a portion extending from the edge of the folded sheet covering the outside surfaces of the lenses and frame so that the extended portion of said sheet is capable of being folded about a second axis to cover folded temples of said eyeglasses to secure the folded temples to said sheet, said sheet being unfoldable from said folded condition to said flat condition, said sheet further comprises at least one orifice capable of receiving a temple of said eyeglasses, said sheet further comprising releasable fastening means attached to said sheet for releasably retaining said sheet in said folded condition.

2. The wrap defined in claim 1 wherein said extended portion is securing means adapted to said sheet to secure at least one temple of said eyeglasses against an exterior surface of a portion of said sheet covering said inside surfaces of lenses and frame in said eyeglasses.

3. The wrap defined in claim 1 wherein said releasable fastening means comprise Velcro strips.

4. The wrap defined in claim 1 wherein said sheet further comprises at least one pair of orifices, each orifice of said pair of orifices capable of receiving a different temple from said pair of eyeglasses.

5. The wrap defined in claim 4 wherein said extended portion contains securing means adapted to said sheet to secure at least one temple of said eyeglasses against an exterior surface of a portion of said sheet covering said inside surfaces of said lenses and frame in said eyeglasses.

6. A wrap for a pair of eyeglasses, said eyeglasses comprising a frame containing a first lens and a second lens and a nosepiece bridging said lenses, said eyeglasses further comprise a first temple attached to a portion of said frame contacting said first lens and a second temple attached to a portion of said frame contacting said second lens; said eyeglasses further comprise said first temple hingedly attached to a portion of said frame contacting said first lens and said second temple attached to a portion of said frame contacting said second lens; said wrap comprising a flat sheet of flexible material, which is sized and shaped to be foldable from a flat condition into a folded condition in which (1) at least a major portion of the outside surfaces of said first lens and said second lens and said frame, and (2) at least a major portion of the inside surfaces of said first lens and said second lens and said frame are covered and said sheet being unfoldable from said folded condition to said flat condition, said sheet bordered by a top edge, bottom edge and two general side edges, said sheet foldable about a bending axis traversing said general side edges, said sheet comprising a top portion sized and shaped to cover the outside surfaces of said first lens and said second lens and said frame, said top portion bordered by said top edge, top side edges and said bending axis, said sheet further comprising a bottom portion sized and shaped to cover the inside surfaces of said first lens and said second lens and said frame, said bottom portion bordered by said bottom edge, bottom-side edges and said bending axis, said sheet further comprises at least one pair of orifices, each orifice of at least one pair of orifices being of sufficient size and sufficient distance from each other to allow said first and said second temples to pass through different orifices of said pair of orifices for a sufficient distance to allow the interior surfaces of said sheet located between said orifices to generally contour to said inside surfaces of said lenses and said frame, said wrap further comprises securing means adapted to said sheet to at least secure said first temple against the exterior surface of said bottom portion of said sheet when at least said first temple has passed through an orifice and is folded and contacts said bottom portion of said sheet, said securing means comprise an extension top-edge portion of said top portion of said sheet and is sized and fitted to secure at least said first temple against the exterior surface of said bottom portion of said sheet close to said bending axis when at least said first temple is folded and contacts said exterior surface of said bottom portion of said sheet, and said top portion of said sheet further comprising releasable fastening means to retain said top portion of said sheet to said bottom portion of said sheet when said sheet is folded to simultaneously cover said inside surfaces and said outside surfaces of said lenses and said frame.

7. The wrap defined in claim 6 wherein said flexible material is selected from the group consisting of rubber, foam rubber, leather, synthetic leather, hide, shammy, sheep shammy, neoprene, fabric, fabric-covered rubber and fabric-covered neoprene.

8. The wrap defined in claim 6 wherein said flexible material comprises a closed cell sponge neoprene.

9. The wrap defined in claim 6 wherein said bottom portion of said sheet further comprises releasable fastening means coacting with said releasable fastening means on said extension-top edge portion of said top portion of said sheet.

10. The wrap defined in claim 9 wherein said coacting releasable fastening means comprise coacting flat hook or loop strips on the interior surfaces of said extension top-edge portion of said sheet and on the exterior surface of said bottom portion of said sheet and said flexible material comprises fabric-covered closed cell sponge neoprene.

11. The wrap defined in claim 6 wherein said orifices are positioned close to said general side edges of said sheet.

12. The wrap defined in claim 6 wherein at least one of said orifices contains at least one surface having a straight line.

13. The wrap defined in claim 6 wherein at least one of said orifices contains at least one curved surface.

14. The wrap defined in claim 6 wherein said flexible material comprises a fabric-covered closed cell sponge neoprene and said releasable fastening means comprise flat coacting hook or loop strips on the interior surface of said top portion and the interior surface of said bottom portion of said sheet.

15. The wrap defined in claim 6 wherein said second temple is folded and secured against said first temple or against said bottom portion of said sheet, and wherein said securing means comprises releasable fastening means.

16. The wrap defined in claim 6 wherein said second temple is folded and secured against said first temple or against said bottom portion of said sheet, ad said extension top-edge portion of said top portion of said sheet comprises releasable fastening means on the interior surface which is capable of coacting with said releasable fastening means on the exterior surface of said bottom portion.

17. The wrap defined in claim 16 wherein said releasable fastening means on said exterior surface of said sheet comprises hook or loop strips attached to said bottom portion or said top portion of said sheet.

18. A wrap for a pair of eyeglasses, said eyeglasses comprising a frame containing a first lens, a second lens, a nosepiece bridging said lenses, a first temple attached to a portion of said frame contacting said first lens, a second temple attached to a portion of said frame contacting said second lens, said first temple capable of folding to contact the inside surfaces of said second lenses or said frame contacting said second lens, and said second temple capable of folding to contact the inside surfaces of said first lens or said frame contacting said first lens, said wrap comprising a flat sheet of flexible material having an exterior surface and an interior surface, said sheet is sized and shaped with a top edge, bottom edge and two general side edges, said sheet foldable from a flat condition into a folded condition in which said sheet forms (i) a bottom portion bordered by said bottom edge, at least two bottom-side edges of said general side edges, and a first bending axis traversing said general side edges, said bottom portion having sufficient surface area to cover at least a major portion of the inside surfaces of said first lens and said second lens and said frame (ii) a top portion bordered by top-side edges of said general side edges, said first bending axis and a second bending axis traversing said general side edges and parallel to said first bending axis and having sufficient surface area to cover at least a major portion of the outside surfaces of said first lens and said second lens and said frame, and (iii) an extension top-edge portion bordered by said second bending axis, said top edge and extension top-side edges, and being sized and shaped to secure said temples against said exterior surface of said bottom portion of said sheet, said bottom portion comprising releasable fastening means attached on said exterior surface close to said first bending axis on or about a top edge-to-bottom edge centerline bisecting said sheet, said bottom portion comprising at least one pair of orifices positioned essentially equidistant from said top edge-to-bottom edge centerline and being of sufficient size and of sufficient distance from said top edge-to-bottom edge centerline to allow said first temple to pass through a first orifice of said pair and to allow said second temple to pass through a second orifice of said pair for a sufficient distance to allow (a) the interior surface of said sheet located between said orifices to generally contour to said inside surfaces of said lenses and said frame and (b) said first temple to fold and contact said exterior surface of said bottom portion of said sheet and (c) said second temple to fold and contact said exterior surface of said bottom portion of said sheet or said first temple, said extension top edge portion comprising flat releasable fastening means on said interior surface close to said top edge on or about said top edge-to-bottom edge centerline, said flat releasable fastening means on said interior surface capable of coacting with said releasable fastening means on said exterior surface of said bottom portion to secure sad temples against said exterior surface of said bottom portion of said sheet and wherein said sheet being unfoldable from said folded condition to said flat condition.

19. The wrap defined in claim 18 wherein said orifices are positioned close to said general side edges of said sheet.

20. The wrap defined in claim 18 wherein at least one of said orifices contains at least one surface having a straight line.

21. The wrap defined in claim 18 wherein at least one of said orifices contains at least one curved surface.

22. The wrap defined in claim 18 wherein said flexible material comprises a fabric-covered closed cell sponge neoprene and said releasable fastening means comprise at least one flat coacting hook or loop strip on the interior surface of said extension top edge portion and said exterior surface of said bottom portion of said sheet.

23. The wrap defined in claim 18 wherein said flexible material is selected from the group consisting of rubber, foam rubber, leather, synthetic leather, hide, shammy, sheep shammy, neoprene, fabric, fabric-covered rubber and fabric-covered neoprene.

24. The wrap defined in claim 18 wherein said flexible material comprises a closed cell sponge neoprene having a nylon cover.

25. The wrap defined in claim 24 wherein said flexible material further comprises a nylon cover on said neoprene.

26. A wrap for a pair of eyeglasses, said eyeglasses comprising a frame containing a first lens, a second lens, a nosepiece bridging said lenses, a first temple attached to a portion of said frame contacting said first lens, a second temple attached to a portion of said frame contacting said second lens, said first temple capable of folding to contact the inside surfaces of said second lenses or said frame contacting said second lens, and said second temple capable of folding to contact the inside surfaces of said first lens or said frame contacting said first lens, said wrap comprising a flat sheet of flexible material having an exterior surface and an interior surface, said sheet is sized and shaped with a top edge, bottom edge and two general side edges, said sheet foldable from a flat condition into a folded condition in which said sheet forms (i) a bottom portion bordered by said bottom edge, bottom-side edges of said general side edges, a first bending axis traversing said general side edges, said bottom portion having sufficient surface area to cover at least a major portion of the inside surfaces of said first lens and said second lens and said frame (ii) a top portion bordered by top-side edges of said general side edges, said first bending axis and a second bending axis traversing said general side edges and parallel to said first bending axis and having sufficient surface area to cover at least a major portion of the outside surfaces of said first lens and said second lens and said frame, and (iii) an extension top edge portion bordered by said second bending axis, said top edge and at least two extension top side edges, and being sized and shaped to secure said temples against said exterior surface of said bottom portion of said sheet, said bottom portion comprising releasable fastening means attached on said exterior surface close to said first bending axis on or about a top edge-to-bottom edge centerline bisecting said sheet, said bottom portion further comprises at least one orifice positioned close to each of said general side edges of said bottom portion of said sheet, each orifice being of sufficient size, shape and distance from an orifice close to the opposite bottom-side edge so as to be in juxtaposition with said folding areas of said first and second temples, and when said first and second temples are folded against the exterior surface of said bottom portion, said sheet located between said orifices is generally contoured to said inside surfaces of said lenses and said frame, said extension top edge portion comprising flat releasable fastening means on said interior surface close to said top edge on or about said top edge-to-bottom edge centerline, said releasable fastening means on said interior surface capable of coacting with said releasable fastening means on said exterior surface of said bottom portion to secure said temples against said exterior surface of said bottom portion of sheet, and wherein said sheet being unfoldable from said folded condition to said flat condition.

27. The wrap defined in claim 26 wherein said orifice is of sufficient size and shape to restrict significant sliding movement of said bottom portion of said sheet over said frame and said inside surfaces of said lenses when said extension top edge portion and said bottom portion of said sheet are fastened, said sliding movement includes lateral movement or movement directionally about said top-to-bottom centerline bisecting said sheet.

28. The wrap defined in claim 27 wherein said releasable fastening means comprise coacting flat hook or loop strips and said flexible material comprises a fabric-covered closed cell sponge neoprene.

29. The wrap defined in claim 26 wherein said flexible material is selected from the group consisting of rubber, foam rubber, leather, synthetic leather, hide, shammy, sheep shammy, neoprene, fabric, fabric-covered rubber and fabric-covered neoprene.

* * * * *